United States Patent [19]

Malcolm

[11] Patent Number: 4,795,960

[45] Date of Patent: Jan. 3, 1989

[54] PROGRAMMABLE ATTENUATORS

[76] Inventor: Bruce Malcolm, 6840 Winona Dr., Indianapolis, Ind. 46236

[21] Appl. No.: 937,100

[22] Filed: Dec. 2, 1986

[51] Int. Cl.[4] ..... H01P 1/10; H01P 1/22

[52] U.S. Cl. ..... 333/105; 333/81 A; 333/246

[58] Field of Search ..... 333/101, 104, 105, 81 A, 333/103, 81 R, 161, 164; 335/128

[56] References Cited

U.S. PATENT DOCUMENTS

| | | | |
|---|---|---|---|
| 3,365,701 | 1/1968 | Jones, Jr. | 333/101 X |
| 3,470,499 | 9/1969 | Lentz | 333/101 |
| 4,330,765 | 5/1982 | Patukonis | 333/81 A |
| 4,442,325 | 4/1984 | McDermott | 333/81 A X |
| 4,612,520 | 9/1986 | Boire et al. | 333/161 X |
| 4,613,840 | 9/1986 | Yabu et al. | 335/128 |
| 4,625,191 | 11/1986 | Oberndorfer et al. | 335/128 X |

*Primary Examiner*—Paul Gensler

*Attorney, Agent, or Firm*—Neuman, Williams, Anderson & Olson

[57] ABSTRACT

Programmable attenuators including DPDT relays or pairs of SPDT relays with terminals which are interconnected through conductors and attenuator sections disposed on opposite sides of grounded isolation elements, and so configured and supported by printed circuit boards or the like as to provide very high isolation while obtaining flat response characteristics up to very high frequencies, in the megahertz range.

14 Claims, 3 Drawing Sheets

PROGRAMMABLE ATTENUATORS

This invention relates to programmable attenuators or the like and more particularly to devices which include or are usable with relays or other switching devices for control of attenuation or frequency response characteristics. The devices of the invention are operable over a wide range of frequencies which may extend from DC to the gigahertz range and they have characteristics such as to avoid impedance mis-matches and the generation of undesirable standing waves. They are highly reliable in operation and are also versatile being readily adapted for various applications. They are usable with or include relays or switching devices of types which are readily available at low cost.

BACKGROUND OF THE INVENTION

One prior art type of programmable attenuator includes a plurality of attenuator sections, each connected to terminals of a double pole, double throw relay to be switched into or out of a serial energy transmission path and to obtain an amount of attenuation which is controllable in steps by selective control of the relays. For example, with a series of four sections having attenuations of 1 dB, 2 dB, 4 dB and 8 dB, it is possible to obtain attenuation of from zero to 15 dB in 1 dB steps. One programmable attenuator of this type is illustrated in the Patukonis U.S. Pat. No. 4,330,765. Such attenuators may be used to obtain quite satisfactory results in many applications. However, they have had limitations with respect to the amount of attenuation which might be obtained in one section and with respect to the highest frequency at which a flat response can be obtained. Also, they have used relays of a special parallel DPDT (double pole, double throw) configuration such as to provide alternate parallel non-crossing paths between two sets of terminals, one path using a minimum or "zero" attenuator. The avoidance of crossing paths has advantages but such relays are expensive and this type of attenuator has otherwise been costly to manufacture.

There are other types of attenuators in the prior art, including push-button actuated, rotary or other mechanically actuated attenuators and solid state attenuators but all known types of attenuators have features such that they are not readily controlled from a remote location, or they have reliability problems, or the frequency range of operation is limited at either the high end or the low end or they are too large in size or too expensive to manufacture or have other disadvantages.

SUMMARY OF THE INVENTION

This invention was evolved with the general object of overcoming disadvantages of prior art attenuators and of providing programmable attenuators which are operable with a high degree of reliability and with flat response over a wide frequency range, from DC to 1 gigahertz or more, without producing undesirable standing waves and while being readily and economically manufacturable.

An important aspect of the invention relates to the discovery and recognition of the sources of problems with prior art devices, particularly with respect to relay-activated attenuators. Typically, such attenuators use a double pole, double throw relay having one pair of terminals directly connected through a conductor to provide a minimum loss path and having a second pair of terminals connected to an attenuator network to provide a higher loss path, such paths being selectively connected in series in the path of energy propagation. To obtain satisfactory operation at high frequencies, it has been considered to be necessary to use a type of relay such as a relay in a TO-5 package manufactured by Teledyne Corporation which has a construction such that the alternate paths are short and spaced in parallel relation. The shortness of the paths minimizes the impedance discontinuity produced by the relay and permits operation at fairly high frequencies, on the order of 1 gigahertz or more which may be increased by special compensating or "tweaking" techniques. Also, it is possible to obtain an amount of isolation between such short and spaced paths which is sufficient for many applications. However, both the frequency range of operation and the degree of isolation are limited. Also, such relays are very expensive, it apparently being necessary to use special manufacturing techniques to obtain the short parallel paths and a small TO-5 package.

In accordance with this invention, a structure is provided with a double pole double throw relay or other switch device which provides terminals at the ends of two alternate paths for energy propagation. The structure includes an element of conductive material which may be connected to ground structure of the relay or other switch device and which may preferably be in the form of a grounded conductive layer on a substrate or sheet of insulating material. The element is disposed between impedance elements in the two alternate paths and, for example, the impedance element in one path may be a direct conductive connection while elements may be disposed in the other paths to form an attenuator section. Preferably, the grounded element is so positioned relative to the elements of the two paths as to avoid any substantial impedance mis-match and to permit operation with flat response and up to very high frequencies. The grounded element is also operative to provide a high degree of isolation between the two paths which is very advantageous in many applications in that a very high degree of attenuation may be obtained in a single section, increasing the range of attenuation obtainable without increasing the number of sections, or reducing the number of sections required to produce a given range of attenuation.

In accordance with an important feature of the invention, the structure is usable with types of relays which are readily available and which are much less expensive than the aforementioned TO-5 type of relay. For example, a double pole, double throw relay may be used of a type in which alternate paths are in crossing diagonal relationship. Such relays have been considered to be unsuitable for use in programmable attenuators operable at high frequencies because the lengths of the paths are quite long so that impedance discontinuities would be produced and also because the couplings between the crossing paths reduces the isolation between the paths. In addition, the lengths of internal switching paths of relays of this type are quite long, exacerbating the apparent problems. The structure of this invention makes it possible to minimize any impedance mis-match and consequent generation of standing waves, even though the internal and external path lengths provided by the relay may be quite long. It also has an important advantage in providing a high degree of isolation between paths. As a result, it is possible to use inexpensive relays and operate at very high frequencies while also obtaining the advantages of a very high degree of isolation.

Additional important specific features of the invention relate to the configuration of the structure, for obtaining optimum results while facilitating manufacture at low cost. As aforementioned, the isolation element may preferably include a grounded conductive layer on a substrate or sheet of insulating material and such a sheet may preferably be part of a support structure for the impedance elements of the two alternate paths. For example, attenuator elements may be supported on one face of the sheet while a conductive layer portion is disposed on the opposite side of the sheet to define the isolation element. In addition, grounded conductive layer portions may be provided on the same side of the sheet as that which supports the attenuation elements. A second sheet may preferably be included for supporting a second strip which forms a single impedance element of the alternate path. In addition, a third sheet may be provided having grounded conductive layer portions for cooperation with the strip on the second sheet in a manner such as to obtain optimum impedance characteristics.

The sheets may also carry conductive layer portions which are so arranged as to facilitate assembly of relays thereon and to otherwise facilitate manufacture at low cost.

The structure of the invention may be thus readily assembled from separate circuit boards but it will be understood that a multi-layer type of circuit board may be used. Other configurations may alternatively be used to obtain both high isolation and impedance matching while operating at frequencies in the gigahertz range and using low cost relays. The invention has a number of other important features and advantages which will become more fully apparent from the following detailed description taken in conjunction with the accompanying drawings.

DESCRIPTION OF PREFERRED EMBODIMENTS

Figure 1:
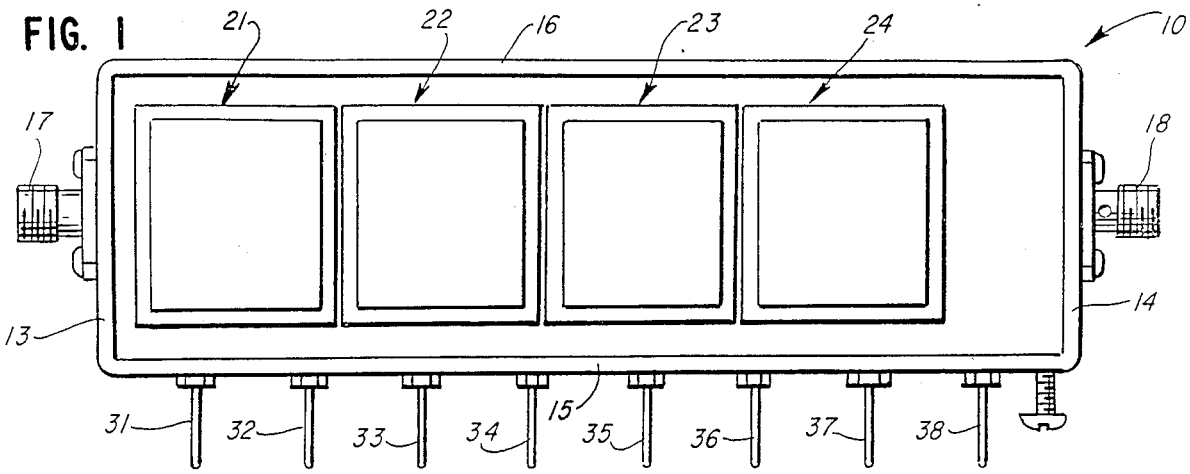
FIG. 1 is a top plan view of an attenuator constructed in accordance with the invention, with a top cover plate removed.

Reference numeral 10 generally designates a relay activated programmable attenuator constructed in accordance with the principles of this invention. The attenuator 10 is designed to control attenuation of signals between coaxial lines connected thereto and may be used in instrumentation and various other applications. It is operable over a wide frequency range, from DC up to a frequency of on the order of 2 GHz or higher, and when connected to coaxial lines having a certain characteristic impedance for which it is designed, 50 or 75 ohms for example, it produces minimal standing waves on the lines connected thereto.

The illustrated attenuator 10 includes a metallic housing having end walls 13 and 14 and side walls 15 and 16, input and output coaxial line fittings 17 and 18 projecting from the end walls 13 and 14 and covers, not shown, which provide top and bottom walls and which are preferably of metal. An internal wall 20 supports four relays 21, 22, 23 and 24 on its upper side and four attenuator sections 25, 26, 27 and 28 on its lower side, such attenuator sections being connected seriatim between the input and output coaxial line fittings 17 and 18.

Each of the relays 21–24 is actuatable between two states to obtain either a predetermined attenuation or substantially zero attenuation by the corresponding one of the sections 25–28 and a number of attenuation levels may be obtained by selective control of the four relays. For example, the sections 25–28 may respectively produce attenuations of 10 dB, 20 dB, 30 dB and 40 dB, so that attenuations of from zero to 100 dB may be obtained in 10 dB steps. To control the relays, a source of control signals which may be at a remote location is connected through a suitable connector cable to eight pins 31–38 which have outer ends projecting from the wall 15 and inner ends connected to coils of the relays 21–24. For example, a drive signal may be applied to pin 31 to switch the relay 21 to one state and to obtain substantially zero attenuation in the section 25, while a drive signal may be applied to the pin 32 to switch the relay 21 to a second state and to obtain a 10 dB attenuation, or some other predetermined attenuator in the section 25. The relays 21–25 may be latching relays but it will be understood that other types of relays may be used and also that switching devices other than relays may be used in the practice of the invention.

Figure 9:
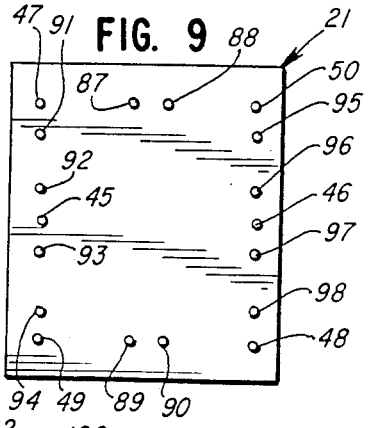
FIG. 9 is a bottom plan view of a relay of the attenuator.

In the illustrated apparatus, the support wall 20 is in the form of a printed circuit board and, in forming each of the attenuator sections 25–28, two additional boards are secured under a portion of the board 20 and conductor portions on the boards are soldered or otherwise connected to terminal pins of the relays and to circuit elements on the boards. FIGS. 3–8 show the undersides and top-sides of a portion of the board 20 and of two additional boards 41 and 42 as they appear before their assembly in forming the attenuator section 25. FIG. 9 shows the underside of the relay 21, before assembly, FIG. 10 shows diagrammatically the internal construction and operation of the relay 21 and FIG. 11 is a cross-sectional view of a portion of the apparatus, illustrating the attenuator section 25 after assembly.

Figure 2:
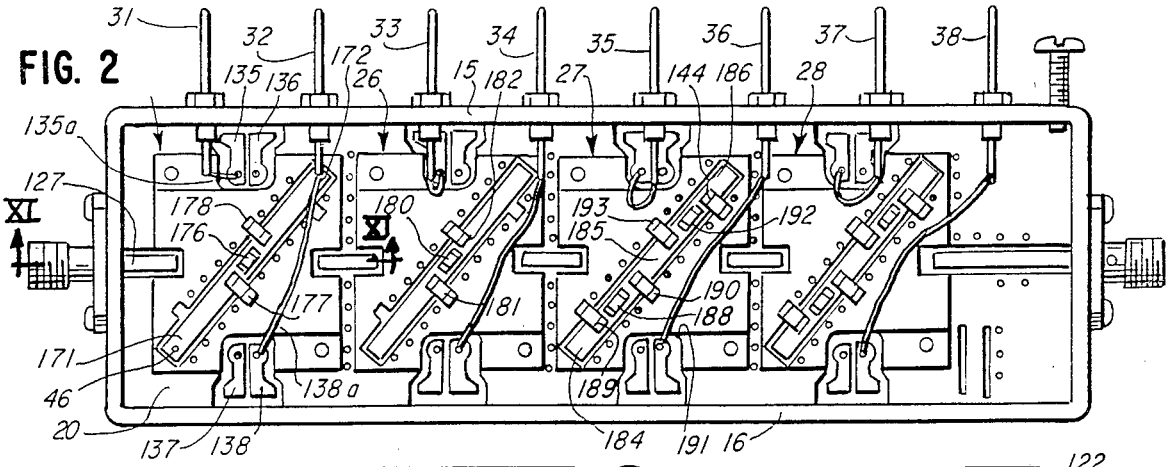
FIG. 2 is a bottom plan view of the attenuator of FIG. 1, with a bottom cover plate removed.
Figure 11:
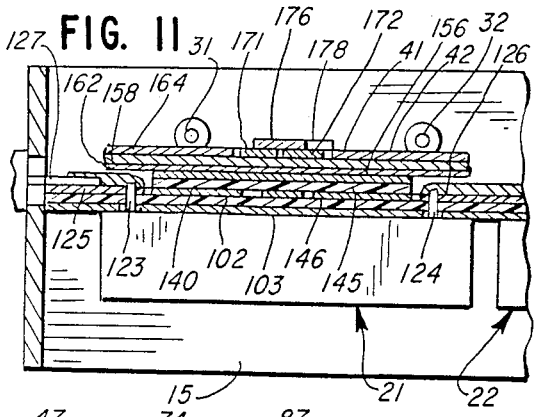
FIG. 11 is an elevational cross-sectional view with an upside-down orientation, taken substantially along XI—XI of the bottom plan view of FIG. 2 but with the thicknesses of insulating sheets and conductive layers being exaggerated.

It is noted that FIG. 11 has an upside-down orientation with the relay 21 appearing to be on the underside of the board 20, FIG. 11 being an elevational cross-sectional view of FIG. 2 which is a bottom plan view of the apparatus.

Figure 10:
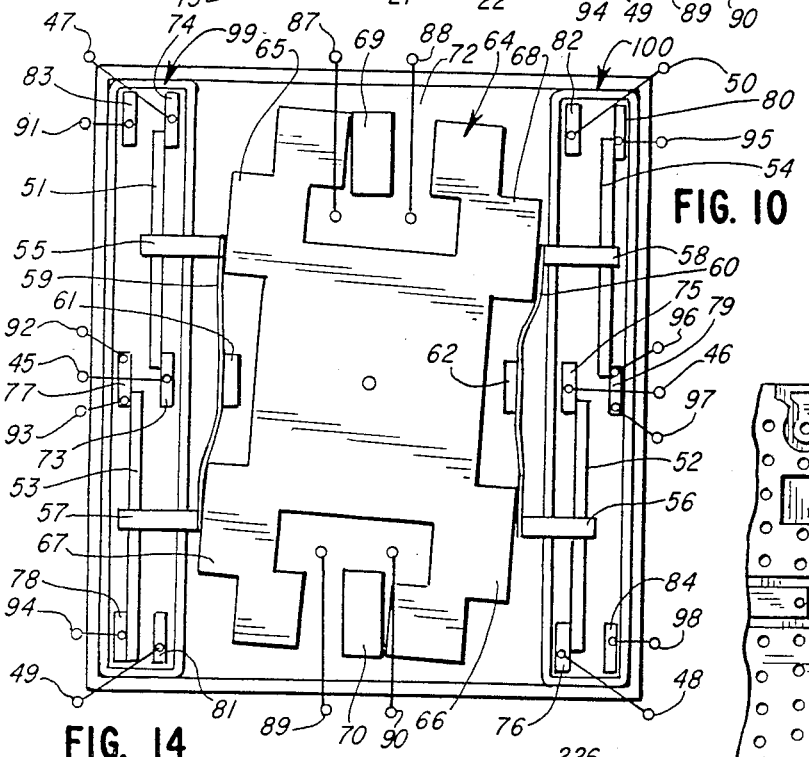
FIG. 10 shows diagrammatically the internal construction of the relay of FIG. 9 and the connection of various elements to pins thereof.

Referring first to FIGS. 9 and 10, the relay 21 includes pins 45 and 46 which are respectively connected to pins 47 and 48 in a first state of the relay and to pins 49 and 50 in a second state of the relay. As illustrated, such switch connections are effected through four movable conductors or contacts 51–54 mounted on contact blocks 55–58 which are affixed to the outer ends of two leaf spring central members 59 and 60 to be urged inwardly, central portions of the spring members 59 and 60 being fixedly supported on posts 61 and 62. A pivotal armature block 64 has actuating portions 65–68 engagable with the contact blocks 55–58 and it carries magnets for cooperation with poles 69 and 70 of a magnetic yoke having a coil unit 72 thereon, two separate coils being provided in unit 72 of the illustrated relay. When one of the coils of unit 72 is energized, the armature block 64 is moved to, or remains in, a position as shown in which spring 59 holds contact 51 in an inward position to bridge and connect a fixed contact 73 connected to pin 45 and a fixed contact 74 connected to pin 47 and in which contact 52 in a similar fashion connects a fixed contact 75 connected to pin 46 and a fixed contact 76 connected to pin 48. At the same time, contact 53 is engaged with two fixed contacts 77 and 78 while contact 54 is engaged with two fixed contacts 79 and 80, contacts 77–80 being connected to ground to insure grounding of the contacts 53 and 54 in this state of the relay and to obtain high isolation of high frequency energy between contacts 73 and/or 74 and 81 and contacts 75 and/or 76 and 82.

When the other coil is energized, the armature block 64 is pivoted in a counter-clockwise direction, as illustrated, contact 53 connects contact 73 and a contact 81 which is connected to pin 49 and contact 54 connects contact 75 and a contact 82 which is connected to pin 50. At the same time, contact 51 engages ground contact 77 and another ground contact 83 while contact 52 engages ground contact 79 and another ground contact 84. Once actuated to either position, the block 64 is held or latched in that position until the appropriate coil is energized to effect a state reversal.

One of the relay coils is connected to pins 87 and 88 while the other is connected to pins 89 and 90. Additional pins 91–98 are provided which are connected to the ground contacts and also to metallic shields 99 and 100 which have portions extending along in spaced relation to the operative contacts in either state of the relay, minimizing impedance discontinuities which might result in the production of standing waves at high frequencies. This type of relay is relatively inexpensive but it has impedance characteristics which make it possible to obtain uniform response from DC up to very high frequencies, when the structures of the invention are used in conjunction therewith.

The illustrated relay 21 is of what may be described as a diagonal type in that in one state of the relay an interconnection must be made between the terminals 47 and 48 which are positioned in diagonal relation, on opposite sides of an imaginary plane through the terminals 45 and 46. In the other state, an interconnection must be made between the terminals 49 and 50 which are also positioned in diagonal relation, on opposite sides of the plane of terminals 45 and 46. Such interconnections thus must cross in proximity to each other in a region at or in the vicinity of the plane of terminals 45 and 46. The structure of the invention is especially advantageous when used with a relay of this type, in obviating problems which would otherwise result from the proximity of interconnections. However, a number of features of the invention may be used advantageously with other types of relay or switch constructions including single pole, double throw relays as described hereinafter.

Figure 6:
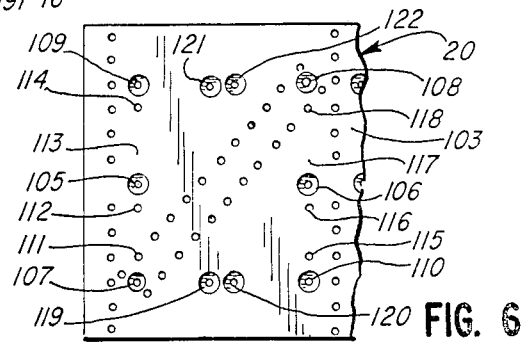
FIG. 6 is a top plan view of the portion of a circuit board shown in FIG. 3.

The board 20 includes a substrate or sheet 102 of insulating material shown in the cross-sectional view of FIG. 11, having a ground layer 103 of conductive material on its upper surface (FIG. 6). When the relay 21 is disposed with its lower side (FIG. 9) in facing relation to the upper side of the board 20 (FIG. 6), the pins 45–50 respectively extend downwardly through openings 105–110 in the insulating sheet 102 but do not engage the conductive layer 103 which has openings of larger diameter than the openings 105–110, in concentric relation thereto. Ground pins 91–98, however, extend through small diameter openings 111–118 in the ground layer 103 and through openings in the sheet 102 aligned therewith, such openings preferably being plated-through openings so that all of the ground pins 91–98 are in direct conductive engagement with the conductive layer 103. Pins 87–90, which connect to the coils of the coil unit 72, extend down through openings 119–122 in the sheet 102, such being surrounded by openings of larger diameter in the sheet 103 (FIG. 6).

Figure 3:
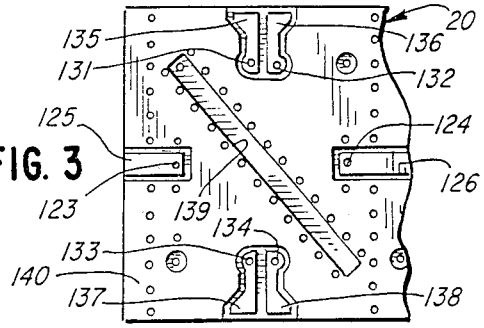
FIG. 3 is a bottom plan view of a portion of a circuit board of the attenuator of FIG. 1, used in constructing one attenuator section, showing the form of the circuit board before assembly.

Pins 45 and 46 extend downwardly through the openings 105 and 106 of the sheet 102 of board 20 and into openings 123 and 124 in conductive layer portions 125 and 126 on the underside of sheet 102 (FIG. 3).

Similarly, the coil connect pins 87–90 of the relay 21 extend downwardly through the openings 119–122 and into aligned openings 131–134 in four conductive layer portions 135–138 on the underside of the board 20 (FIG. 3). Pins 87 and 90 and portions 135 and 138 are soldered to and connected through wires 135*a* and 138*a* to the control signal pins 31 and 32 while pins 88 and 89 and portions 136 and 137 are soldered to the walls 15 and 16 (FIG. 2). Other connection combinations may be used to produce different drive logic configurations.

Pins 47 and 48 extend downwardly through the openings 107 and 108 which are at opposite ends of an exposed diagonally extending area of the insulating sheet 12, such area being defined by a rectangular opening 139 in a conductive layer portion 140 which covers most of the underside of the sheet 102 (FIG. 3).

Figure 7:
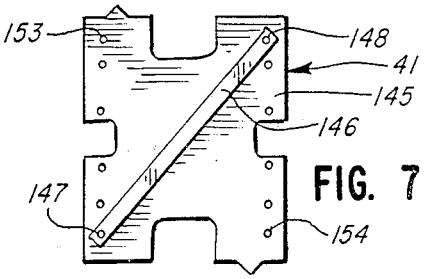
FIG. 7 is a top plan view of the circuit board shown in FIG. 4.
Figure 5:
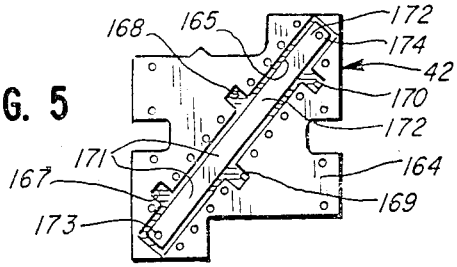
FIG. 5 is a bottom plan view of a third circuit board used in forming one attenuator section.
Figure 8:
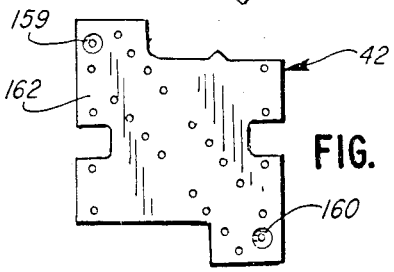
FIG. 8 is a top plan view of the circuit board shown in FIG. 5.

As shown in FIG. 7, the board 41 includes an insulating sheet 145 which has a conductive layer portion on its upper surface, in the form of a diagonally extending strip which has openings 147 and 148 adjacent its opposite ends. When the board 41 is disposed under the board 20, relay pins 47 and 48 extend downwardly through the openings 107 and 108 in the sheet 102 and into the openings 147 and 148 to be interconnected by the strip 146. Strip 146 is narrower and shorter than the opening 139 in the grounded layer 140 to be insulated therefrom.

Figure 4:
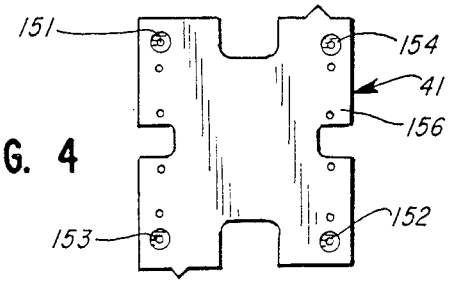
FIG. 4 is a bottom plan view of a second circuit board used in forming one attenuator section.

The sheet 145 of board 41 has openings 151 and 152 which are aligned with openings 147 and 148 and which may receive terminal end portions of pins 47 and 48. It also has openings 153 and 154 for passage of pins of 49 and 50 therethrough and it has a conductive ground layer 156 on the underside thereof. As is shown in FIG. 4, the ground layer 156 is formed with larger diameter openings around openings 151–154 to avoid contact with any of the relay pins 47–50 which are extended through the small openings 151–154 in the sheet 145 of board 41. It is noted that when the boards are assembled, strip 146 is between the ground layers 103 and 156 and it forms a precision stripline transmission line section.

The board 42 includes a similar sheet 158 of insulating material shown in the cross-sectional view of FIG. 11. Sheet 158 has openings 159 and 160 for passage of pins 49 and 50 therethrough and has a conductive ground layer 162 on its upper surface (FIG. 8) with larger diameter openings surrounding openings 159 and 160 for avoiding contact with pins 49 and 50.

On its lower surface, (FIG. 5), the sheet 158 of board 42 has a grounded layer portion 164 which covers most of its surface but which has a diagonally extending opening 165. In the illustrated embodiment, opening 165 is of elongated generally rectangular form but with a pair of notches 167 and 168 along one side thereof and a pair of notches 169 and 170 along its opposite side thereof. Such notches 167–170 are provided for selective installation of impedance elements for obtaining attenuator sections of different forms. In the illustrated embodiment, the first two attenuator sections 25 and 26 are of one form while the second two sections 27 and 28 are of a different form.

Two or more conductive layer portions are disposed on the sheet 158 within the opening 165, depending upon the type of attenuator section desired. For the attenuator section 25 and also for the attenuator section 26, two conductive portions 171 and 172 are provided in end-to-end relationship, such portions having plated-through openings 173 and 174 for receiving the ends of relay pins 49 and 50, such openings being aligned with the openings 159 and 160 in sheet 158. To form the section 25, the adjacent ends of the sections 171 and 172 are interconnected by an impedance element 176 which is thus in series relationship between the pins 49 and 50. The portions 171 and 172 are connected to the ground layer 164 through shunt impedance elements 177 and 178 which may extend into the notches 168 and 169, as shown. Thus, a "pi " type of attenuator network is provided.

The second attenuator section 26 may be formed in a similar manner and may include a series impedance element 180 and two shunt impedance elements 181 and 182. The third attenuator section includes two "pi" networks and, instead of the two layer portions 171 and 172 of the section 25, three portions 184, 185 and 186 are arranged in end-to-end relation. One "pi" network is formed by a series impedance element 188 which interconnects the portions 184 and 185 and two shunt impedance elements 189 and 190 between portions 184 and 185 and a ground layer 191 which corresponds to the ground layer 164. A second "pi" network is formed by a series impedance element 192 which interconnects portions 185 and 186 and two parallel or shunt impedance elements 193 and 194 connected between the portions 185 and 186 and the ground layer 191. Section 28 is formed in the same manner as the section 27, in the illustrated embodiment. It will be understood that networks other than "pi" networks, such as "T" networks may be used.

The structure of the invention provides increased isolation and makes it possible to use a higher attenuation level in one section and it also facilitates the attainment of such a high attenuation level since it allows use of a plurality of networks in a single section. When a high attenuation can be obtained in a single section, the range of attenuation obtainable with a given number of sections is increased or, alternatively, the number of sections required to produce a given attenuation is reduced. For example, using only three sections, usable to produce attenuations of 10 dB, 20 dB and 40 dB, it is possible to obtain attenuation levels to zero to 70 dB in 10 dB steps, such being a highly desirable capability in a number of practical applications.

It is noteworthy that all of the holes which extend through the substrates or sheets 102, 145 and 158 of boards 20, 41 and 42 and which receive pins for connection to conductive layers on one or both sides of the substrate or sheet are preferably plated-through holes, i.e. holes defined by inside plated conductive layer which is connected to such layers and which is placed in direct conductive engagement with a pin during assembly. It is also noted that the boards 20 and 42 may preferably have a series of holes along both sides of the openings 139 and 165, as shown, with such holes being plated-through holes to connect ground layers 103 and 140 and ground layers 162 and 164. They thus facilitate the attainment of a continuous and stable ground along the length of the strip 146 and along the strips 171 and 172.

Figure 12:
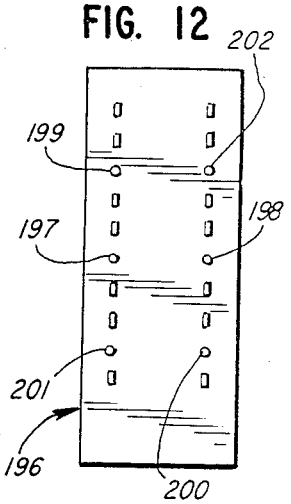
FIG. 12 is a bottom plan view of an alternate form of relay usable in the practice of the invention.

FIG. 12 is a bottom plan view of a relay 196 which is usable with one or more additional relays of the same form, in another embodiment of the invention. Relay 196 is functionally similar to the relays 21–24 but, it is not a latching relay and it has a different configuration with a smaller dimension in the direction of energy propagation and a larger dimension in a transverse direction. It includes terminal pins 197 and 198 which correspond to the pins 45 and 46 of the relay 21 and which are connected to pins 199 and 200 in one state of the relay and to pins 201 and 202 in the other state. Pins 199–202 thus correspond to pins 47–50 of relay 21 and it is noted that relay 196 is of a diagonal type. Additional pins are connected to an actuating coils or to shield elements of the relay which are to be connected to ground.

Figure 13:
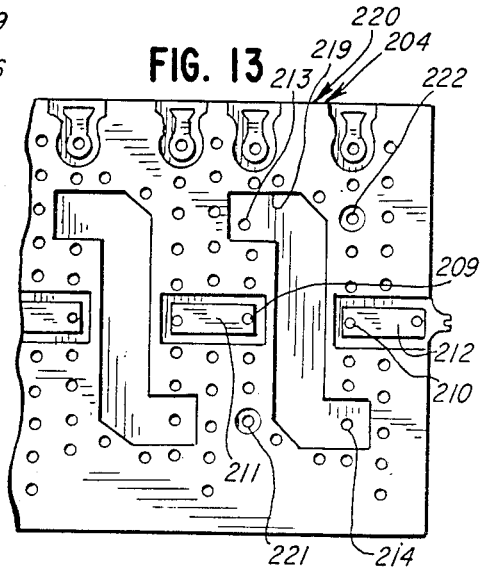
FIG. 13 is a bottom plan view of a portion of a circuit board usable with the relay of FIG. 12.
Figure 14:
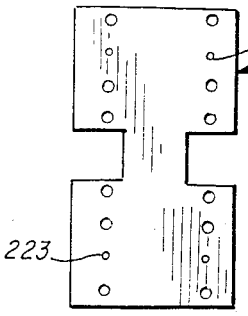
FIG. 14 is a bottom plan view of a circuit board usable with the portion of the circuit board shown in FIG. 13.
Figure 15:
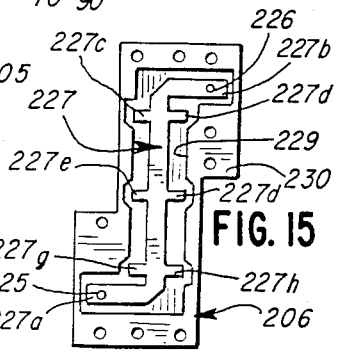
FIG. 15 is a bottom plan view of a second circuit board usable with the circuit board of FIG. 14 and with the portion of the circuit board shown in FIG. 13.
Figure 16:
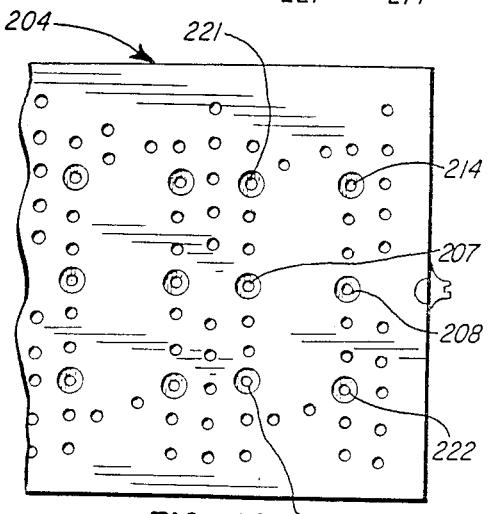
FIG. 16 is a top plan view of the portion of the circuit board shown in FIG. 13.
Figure 17:
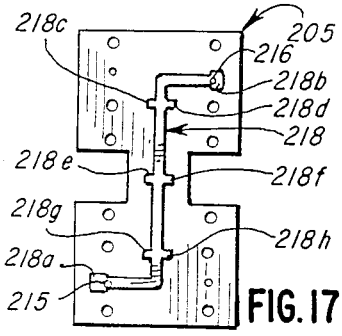
FIG. 17 is a top plan view of the circuit board shown in FIG. 14.
Figure 18:
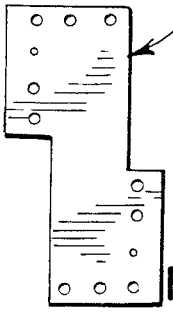
FIG. 18 is a top plan view of the circuit board shown in FIG. 15.

FIG. 13 is a bottom plan view of a portion of a board 204 usable with the relay 196 and additional relays of the same type, FIG. 16 being a top plan view of the portion of the board 204 illustrated in FIG. 13. As shown in FIGS. 14, 15, 17 and 18, two additional boards 205 and 206 are provided for each relay, respectively corresponding to the boards 41 and 42 of the first embodiment. FIG. 14 is a bottom plan view of board 205, FIG. 15 is a bottom plan view of board 206, FIG. 17 is a top plan view of board 205 and FIG. 18 is a top plan view of board 206. When the relay 196 (FIG. 12) is mounted on the top of board 204 (FIG. 16), pins 197 and 198 extend downwardly through openings 207 and 208 of board 204 (FIG. 16) and into openings 209 and 210 of conductive layer portions 211 and 212 on the lower face of the board 204 (FIG. 13). Pins 199 and 200 of relay 196 (FIG. 12) extend downwardly through openings 213 and 214 of the substrate of board 204 (FIG. 16) and into openings 215 and 216 in a conductive strip 218 on the upper face of the board 205 (FIG. 17), the strip 218 being so formed as to be disposed in an opening 219 in a conductive layer 220 on the bottom of the board 204 (FIG. 13). Pins 201 and 202 of relay 196 (FIG. 12) extend through openings 221 and 222 of the substrate of board 204 (FIG. 13), thence through openings 223 and 224 of the board 205 (FIG. 14) and thence into openings 225 and 226 at the ends of a conductive strip 227 on the bottom surface of the board 206 (FIG. 15), the layer 227 being within an opening 229 of a conductive layer 230 on the lower face or bottom surface of the board 206 (FIG. 15). It is noted that the layer 227 may be divided into two or more sections for forming "pi" or other forms of attenuator or filter sections.

The arrangement of FIGS. 12–18 differs from the first embodiment in the configuration of the conductive layers, designed to facilitate use with the narrow type of relay 196, but the operation is generally the same as with the first embodiment.

An important feature of the invention is that the connecting means defined by the boards and conductive elements thereon can be tailored to obtain optimum results in specific applications. This feature is illustrated by consideration of the configuration of the conductive strips 218 and 227 of the boards 205 and 206 as illustrated. These are designed for operation with lines having a characteristic impedance of 50 ohms while using a commercially available OMRON relay, Type No. G5Y-254P, manufactured by OMRON ELECTRONICS, INC., One East Commerce Drive, Schaumburg, Ill. 60195. This relay has a number of desirable features and it is relatively inexpensive but it is found that its electrical characteristics are such that when the strips 218 and 227 are dimensioned to produce a characteristic impedance of 50 ohms, the result is that the response curve is distorted especially at frequencies of about 1.5, 3.0 and 4.5 GHz. It is also found that the features of physical construction of the relay, including the width and length of the relay contacts and the spacing thereof from adjacent ground planes are such that the relay operates in effect as a series inductance. In the illustrated board 205, a certain degree of compensation is produced by portions **218*a* and 218*b* at the ends of the strip 218, having areas such as to effectively produce lumped capacitances. This type of compensation might be adequate with certain relays but additional features are necessary in the case of the relay in question. It is found from a mathematical analysis, using a computer, that it is desirable to reduce the width of the strip to a specific width while also providing one or more additional lumped capacitances along the length of the strip. As shown, the strip 218 is formed with three pairs of projecting ear portions 218*c* and 218*d*, 218*e* and 218*f* and 218*g* and 218*h* at points spaced along its length. The overall result is that the strip 218** cooperates with the relay to form a low pass filter having a high cut-off frequency, of on the order of 5 to 6 GHz, and a response is obtained which is flat, within reasonable limits, up to well over 2 GHz.

Similar features are incorporated in the strip 227 of the board 206, it being noted that the strip 227 operates in cooperation with a single adjacent ground plane as a microstriptype of transmission line, whereas the strip 218 operates between two adjacent ground planes as a stripline type of transmission line. Thus the strip 227 is wider and has portions of greater area but it otherwise has substantially the same configuration as strip 218, with extensions **227*a* and 227*b* at its ends corresponding to portions 218*a* and 218*b* and with projecting ear portions 227*c*–227*h* which respectively correspond to portions 218*c*–218*h*. The dimensions in each case may be as illustrated in the drawings, the width of the board 204 (from the edge thereof which is uppermost in the illustration of FIG. 13 to the edge thereof which is lowermost in the illustration of FIG. 13) being about 1.30 inches and all other dimensions being in about the same proportion as shown in FIGS. 13–18**.

It is noted that in the illustrated embodiment of FIGS. 1–11, each of the relays 21–24 may be a commercially available Aromat Type RG2ET-L2 relay (manufactured by AROMAT CORP., 250 Sheffield St., Mountainside, N.J. 07092) for operation with lines having a characteristic impedance of 50 ohms. The width of the board 20 (from the edge thereof which is uppermost in the illustration of FIG. 3 to the edge thereof which is lowermost in the illustration of FIG. 3) may be about 1.30 inches and all other dimensions may be in the same proportion as illustrated in FIG. 3–8. The attenuator 10 will operate at frequencies in excess of 2 GHz with substantially flat response. For operation with 75 ohm lines, the conductive layer portions 125 and 126 may be widened over that width required for the characteristic impedance to provide increased areas and increased capacitances.

It will be understood that other makes and types of relays may be used and that the dimensions and configurations of the elements may be changed in accordance with the characteristics of such relays, the desired frequency range of operation and the characteristic impedance of the lines with which the units are to be used, specific examples being given to illustrate the principles of the invention and facilitate an understanding of how the invention may be carried out in practice in different applications.

Figure 19:
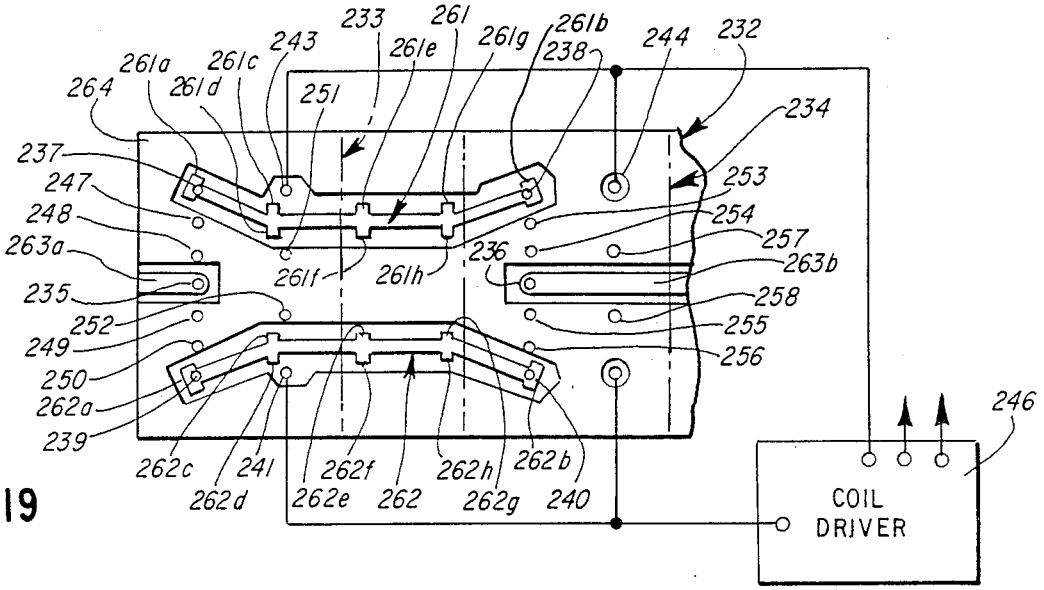
FIG. 19 is a bottom plan view illustrating diagrammatically a modified arrangement in which two SPDT relays are used rather than a DPDT relay.

In both the embodiment of FIGS. 1–11 and the embodiment of FIGS. 12–18, the relays are DPDT relays of the diagonal type in which the two switched paths are in crossing relationship. The invention may also be used with relays which provide paths in parallel non-crossing relationship, two arrangements being illustrated diagrammatically in FIGS. 19 and 20. In FIG. 19, the underside of a portion of a circuit board 232 is shown, disposed under two SPDT relays 233 and 234, indicated in broken lines. Terminals 235 and 236 of relays 233 and 234 are respectively connected to terminals 237 and 238 when the relays are both in a first state and to terminals 239 and 240 when the relays are both in a second state. The relays 233 and 234 also have terminals 241 and 242 for connecting one end of a coil of each relay to a ground terminal and terminals 243 and 244 for connecting the other ends of the coils to a coil driver 246. Ground terminals are also provided, including terminals 247–252 on relay 233 and terminals 253–258 on relay 234.

The circuit board 232 includes conductive strips 261 and 262 which are disposed on the underside of a substrate or sheet of insulating material having a conductive ground layer on its upper side which is disposed against the bottom sides of the relays 233 and 234 and which is connected to the ground terminals. It should also be understood that one of the strips, e.g. strip 262 may be divided into two or more portions for connection to series and shunt resistors or other impedance elements, to form attenuator or filter sections. It is further noted that conductive layer portions 263*a* and 263*b* may be provided on the same substrate for connection to adjacent attenuator or filter sections or to input or output lines and an isolating grounded conductive layer portion 264 may be disposed on the same side of the substrate as the strips 261 and 262 and portions 263*a*, 263*b* and in generally surrounding relation thereto.

The relays 233 and 234 may, for example, be OMRON Type G5Y-154P relays which have characteristics similar to those of the aforementioned OMRON Type G5Y-254P DPDT relays of the example given in connection with FIGS. 12–18 and the strips 261 and 262 may both be formed in a manner similar to the strip 218, shown in FIG. 17 except that they are formed to extend between pins 243, 241, and pins 251, 252. As shown, strip 261 is formed with end portions 261*a* and 261*b*, corresponding to portions 218*a* and 218*b* of strip 218 and with projecting ear portions 261*c*–261*h*. Strip 262 is formed with portions 262*a*–262*h* corresponding to portions 261*a*–261*h*.

Figure 20:
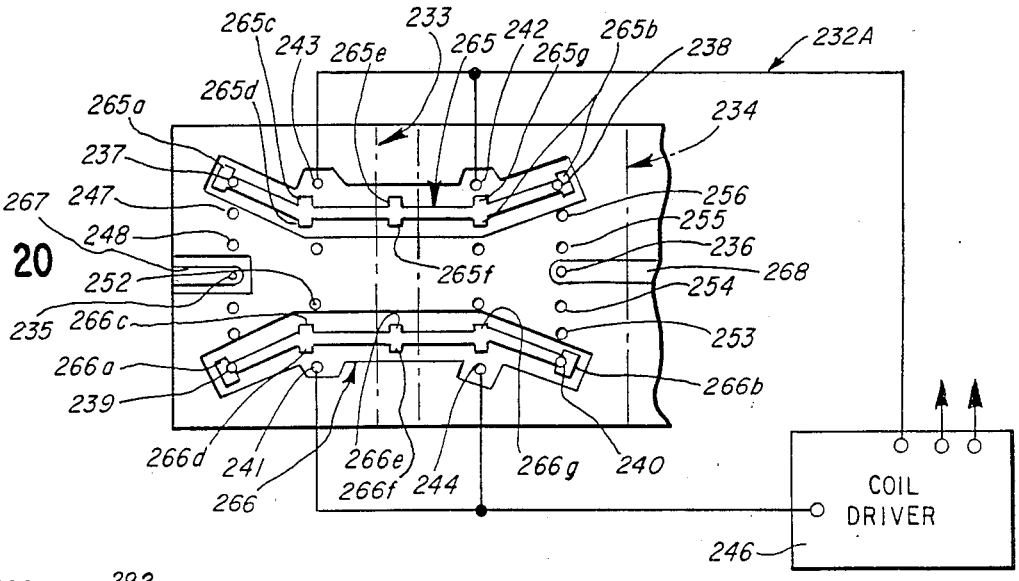
FIG. 20 is a bottom plan view similar to FIG. 19, illustrating another modified arrangement.

In the arrangement of FIG. 19, the relays 233 and 234 are spaced apart a substantial distance in order that the strips 261 and 262 may be of the desired length. FIG. 20 illustrates a board 232A which is like the board 232 of FIG. 19 except that the position of the relay 234 is reversed to place the terminals 236, 238 and 240 on the right side as illustrated, away from the relay 233 so as to permit the relays to be closer together. In this arrangement, strips 265 and 266 are used in place of the strips 261 and 262 and portions 267 and 268 are used in place of the portions 263*a* and 263*b*. Strips 265 and 266 have portions 265*a*–265*h* and 266*a*–266*h* which are like the corresponding portions of strips 261 and 262. Also, the connections of coil terminals 241–244 to the coil driver 246 are reversed so as to place each relay in a state opposite that of the other relay, and so as to take into account the reversal of the position of relay 234 in FIG. 20.

Figure 21:
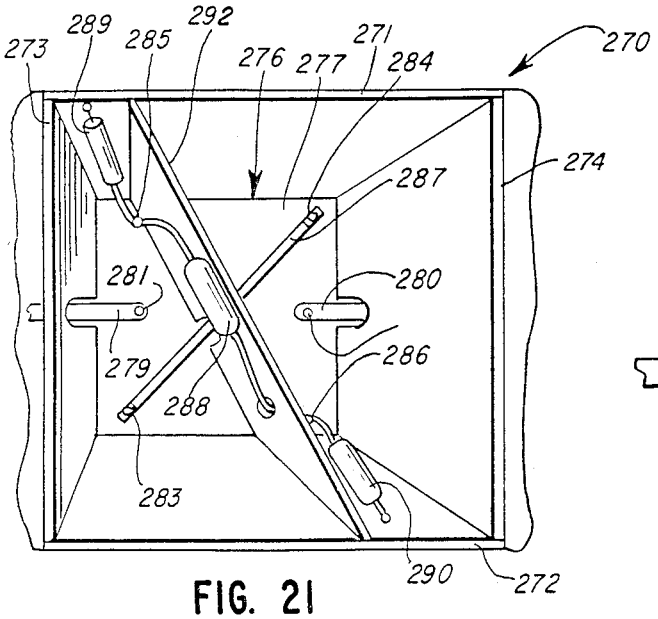
FIG. 21 is a perspective view illustrating a further modified arrangement.

FIG. 21 is a diagrammatic perspective view of the underside of one section of a modified form of attenuator 270 which includes a housing having side walls 271 and 272 and having walls 273 and 274 separating one section from another. A DPDT relay of a diagonal type (not shown) is disposed on the upper side of a circuit board 276 which forms an intermediate wall of the attenuator and which includes a substrate 277 of insulating material which carries conductive layer portions 279 and 280 connected to pins 281 and 282 of the relay. Pins 281 and 282 are connected to pins 283 and 284 in one state of the relay and to pins 285 and 286 in the other state. Pins 283 and 284 are interconnected by a strip 287 while pins 285 and 286 are interconnected by a pi-type attenuator section which includes a series resistor 288 and two shunt resistors 289 and 290. As shown, the series resistor 288 is supported on a wall 292 which is preferably a sheet of metal soldered or otherwise connected to the walls 271 and 272 to form a ground. The body of the resistor 288 is supported away from the strip 287 with leads extending to the pins 285 and 286 and it may be wrapped in foil attached to the wall to ground the foil or otherwise further isolated electrically from the strip 287 and capacity impedance matched to the characteristic impedance. The resistors 289 and 290 are supported along the walls 271 and 272 to provide further isolation from the strip 287.

Figure 22:
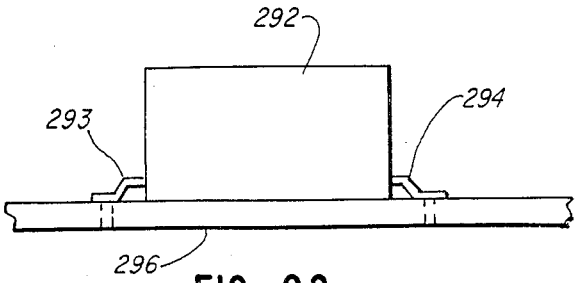
FIG. 22 is a view illustrating the use of a relay having surface-mount terminals.

FIG. 22 illustrates a relay 292 having terminals including terminals 293 and 294 such as to permit surface mounting thereof on a circuit board 296 which may have plated-through holes connected to relay terminals as required. This type of relay may be substituted for any one of the illustrated relays which are of types having terminal pins.

It will be understood that the invention is not limited to attenuators and resistive elements may be replaced by impedance elements which operate to provide desired frequency response, phase shift, delay or other characteristics.

It will also be understood that other modifications and variations may be effected without departing from the spirit and scope of the novel concepts of this invention.

I claim:

1. A high frequency energy reoeiving and propagation structure for use with switch means which are operative between first and second states and which include a conductive ground structure, first, second, third, fourth, fifth and sixth ungrounded terminals and movable switching conductors operable in said first state to respectively connect said first and second terminals to said third and fourth terminals and operable in said second state to respectively connect said first and second terminals to said fifth and sixth terminals, said energy receiving and propagation structure comprising: first and second interconnection means respectively including first and second propagation means each having connection portions at opposite ends thereof, said first interconnection means further including means connecting said connection portions of said first propagation means to said third and fourth terminals of said switch means, said second interconnection means further including means connecting said connection portions of said second propagation means to said fifth and sixth terminals of said switch means, and isolation means of conductive material connected to said conductive ground structure of said switch means and so disposed in relation to said first and second interconnection means as to effectively provide high frequency electrical isolation between said first and second interconnection means said switch means being of such that said third and fourth terminals thereof are on opposite sides of an imaginary plane which extends through said first and second terminals and also being such that said fifth and sixth terminals thereof are also on opposite sides of said imaginary plane, said first and second interconnection means and said first and second propagation means thereof extending in paths which cross each other in a certain region in the vicinity of said plane, and said isolation means being disposed in said region and between said first and second interconnection means and said first and second propagation means thereof.

2. A structure as defined in claim 1, wherein said first and second terminals are for connection to input and output structures having a certain characteristic impedance, said first and second propagation means of said first and second interconnection means cooperating with said isolation means to provide characteristic impedances equal to said certain characteristic impedance in both states of said switch means.

3. A structure as defined in claim 1, comprising support means of insulating sheet material supporting said first and second interconnection means and said isolation means.

4. A structure as defined in claim 1, wherein said support means includes a sheet having a conductive layer portion on one face thereof to form at least part of said isolation means and supporting said first interconnection means on an opposite face thereof.

5. A structure as defined in claim 4, said sheet having conductive layer portions on said opposite face thereof along opposite sides of said first interconnection means and providing an additional part of said isolation means.

6. A structure as defined in claim 4, wherein said support means includes a second sheet having one face in facing relationship to said one face of the first sheet and supporting said second interconnection means on the opposite face thereof.

7. A structure as defined in claim 4, further comprising additional conductive layer portions disposed against said opposite face of said second sheet along opposite sides of said second interconnection means and providing an additional part of said isolation means.

8. A structure as defined in claim 7, wherein said support means further includes a third sheet having one face in facing relation to said opposite face of said second sheet and carrying said additional conductive layer portions.

9. A structure as defined in claim 8, further comprising a conductive layer on the opposite face of said third sheet for disposition between said second interconnection means and said movable switching conductors of said switch means.

10. Apparatus for use as a programmable impedance device or the like, comprising: a series of relays each including a housing and terminals projecting from an end of said housing, said terminals of each relay including first, second, third, fourth, fifth and sixth ungrounded terminals, electromechanical actuating means and movable switching conductors operated by said actuating means to respectively connect said first and second terminals to said third and fourth terminals in one state and to connect said first and second terminals to said fifth and sixth terminals in a second state, said relays being positioned with said terminal ends in side-by-side relation and with said first terminal of all except a first relay of said series adjacent said second terminal of a preceding relay of said series, support means of insulating meaterial positioned adjacent said terminal ends of said series of relays, conductive means carried by said support means and including means connecting said first terminal of all except said first relay of said series to said second terminal of a preceding relay of said series, said support means supporting for each relay of said series first interconnection means between said third and fourth terminals and second interconnection means between said fifth and sixth terminals, each of said first interconnection means including propagation means having connection portions at opposite ends thereof and means connecting said connection portions to said third and fourth terminals, each of said first interconnection means including propagation means having connection portions at opposite ends thereof and means connecting said connection portions thereof to said fifth and sixth terminals, and grounded isolation means of conductive material carried by said support means and so disposed in relation to said first and second interconnection means as to effectively provide high frequency electrical isolation between said first and second interconnection means, each of said relays being of a type such that said third and fourth terminals thereof are on opposite sides of an imaginary plane which extends through said first and second terminals and of a type such that said fifth and sixth terminals thereof are also on opposite sides of said imaginary plane, each of said first and second interconnection means and said propagation means thereof extending in paths which cross each other in a certain region in the vicinity of said plane, and said isolation means being disposed in said region and between said first and second interconnection means and said propagation means thereof.

11. A structure as defined in claim I0, wherein said propagation means of said first interconnection means includes at least one shunt impedance element having one end connected to said isolation means of conductive material and an opposite end coupled to a point between said third and fourth terminals, and at least one series impedance element connected in series between said third and fourth terminals.

12. A structure as defined in claim 10, wherein said propagation means of said second interconnection means comprises an element of conductive material having ends connected to said fifth and sixth terminals.

13. A high frequency energy receiving and propagation structure for use with switch means which are operative between first and second states and which include a conductive ground structure, first, second, third, fourth, fifth and sixth ungrounded terminals and movable switching conductors operable in said first state to respectively connect said first and second terminals to said third and fourth terminals and operable in said second state to respectively connect said first and second terminals to said fifth and sixth terminals, said energy receiving and propagation structure comprising: first and second interconnection means respectively including first and second propagation means each having connection portions at opposite ends therof, said first interconnection means further including means connecting said connection portions of said first propagation means to said third and fourth terminals of said switch means, said second interconnection means further including means connecting said connection portions of said second propagation means to said fifth and sixth terminals of said switch means, and isolation means of conductive material connected to said conductive ground structure of said switch means and so disposed in relation to said first and second interconnection means as to effectively provide high frequency electrical isolation between said first and second interconnection means, said switch means effectively provide high frequency electrical isolation between said first and second interconnection means, said switch means being of such that said third and fourth terminals are both on one side of an imaginary plane which extends through said first and second terminals and also being such that said fifth and sixth terminals are both on the opposite side of said imaginary plane, said first and second propagation means being on opposite sides of said imaginary plane and at substantial distances from said plane and thereby from each other to provide isolation therebetween, and said conductive material of said isolation means extending through said imaginary plane and between said propagation means to provide additional isolation between said first and second propagation means.

14. A structure as defined in claim 13, wherein said switch means comprises two single-pole double-throw relays.

* * * * *

UNITED STATES PATENT AND TRADEMARK OFFICE

CERTIFICATE OF CORRECTION

PATENT NO. : 4,795,960

DATED : January 3, 1989

INVENTOR(S) : Bruce Malcolm

It is certified that error appears in the above-identified patent and that said Letters Patent is hereby corrected as shown below:

Column 5, line 33, after "spring", delete "central".

Column 6, line 68, change "12" to "102".

Column 7, line 4, after "portion", insert --146--.

Column 12, line 27, change "reoeiving" to "receiving".

Column 12, line 53, after "means" (first occurrence) insert a comma (,).

Column 13, line 53, change "meaterial" to "material".

Column 14, line 44, change "therof" to "thereof".

Column 14, line 57, after "means" (first occurrence) delete the rest of the line.
Delete all of line 58.
Line 59, delete "first and second interconnection means,"

Signed and Sealed this

Twenty-first Day of November, 1989

*Attest:*

JEFFREY M. SAMUELS

*Attesting Officer* *Acting Commissioner of Patents and Trademarks*